United States Patent [19]
Key
[11] 4,186,660
[45] Feb. 5, 1980

[54] SCREEN-PRINTING FRAME WITH PLASTIC SIDE BARS BONDABLE TO FABRIC BY SURFACE-SOFTENING

[76] Inventor: John W. Key, 1385 Camino Teresa, Solana Beach, Calif. 92075

[21] Appl. No.: 838,680

[22] Filed: Oct. 3, 1977

[51] Int. Cl.[2] ..... B41F 15/36
[52] U.S. Cl. ..... 101/128.1; 101/128.4
[58] Field of Search ..... 101/127.1, 128.1, 128.2, 101/128.4

[56] References Cited

U.S. PATENT DOCUMENTS

| | | | |
|---|---|---|---|
| 2,545,277 | 3/1951 | Hannah et al. | 101/127.1 |
| 2,989,788 | 6/1961 | Kessler | 101/127.1 X |
| 3,211,089 | 10/1965 | Messerschmidt | 101/127.1 |
| 3,214,314 | 10/1965 | Rowbottom | 101/127.1 X |

FOREIGN PATENT DOCUMENTS

| | | | |
|---|---|---|---|
| 2020958 | 11/1971 | Fed. Rep. of Germany | 101/127.1 |
| 2307993 | 8/1974 | Fed. Rep. of Germany | 101/127.1 |
| 2302855 | 5/1976 | France | 101/127.1 |
| 1041819 | 9/1966 | United Kingdom | 101/127.1 |

*Primary Examiner*—E. H. Eickholt
*Attorney, Agent, or Firm*—Darbo & Vandenburgh

[57] ABSTRACT

For screen printing, in which the screen fabric is tightly stretched across a frame structure, the frame, or at least its side bars, are formed of a plastic material which can be surface-softened by means of solvent or heat for bonding the fabric to it, thus providing the bonding agent in situ. The fabric is initially stretched over the face of the frame structure. The surface of the frame structure is softened, after which, to achieve the bonding, either a solvent is applied to the face surface through the fabric or this surface is heated through the fabric. After completion of the printing job, the fabric may be pulled away from the frame and the frame and fabric repeatedly reused. The removed screen fabric may be stored for future use. Preferably the frame structure is modular, with the side bars removably fitted to corner pieces, so that the side bars may readily be cut to the lengths required for particular screen sizes from long extruded pieces instead of carrying in stock a wide variety of unalterable frames. If the side bars are so long that flexing under the tension of the fabric becomes a problem, they may be prestressed to resist deformation due to fabric tension.

13 Claims, 7 Drawing Figures

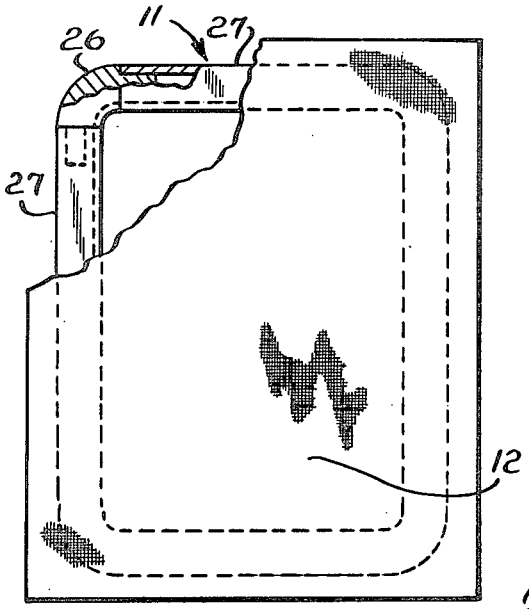
Fig. 1
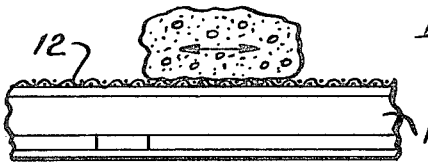
Fig. 6
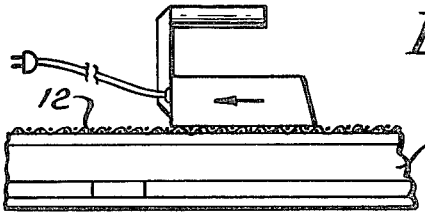
Fig. 7
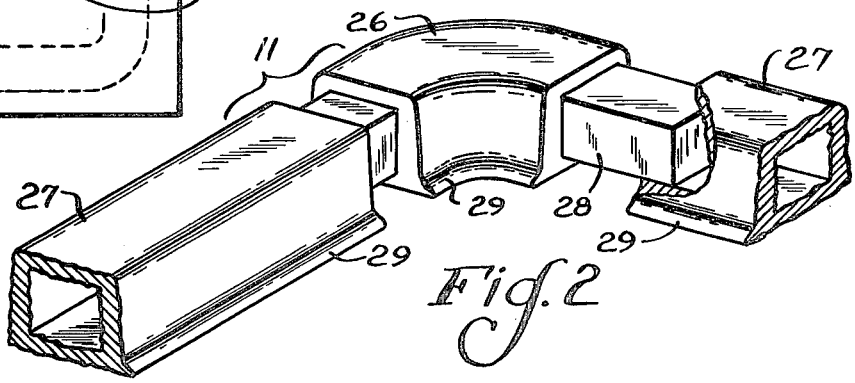
Fig. 2
Fig. 3
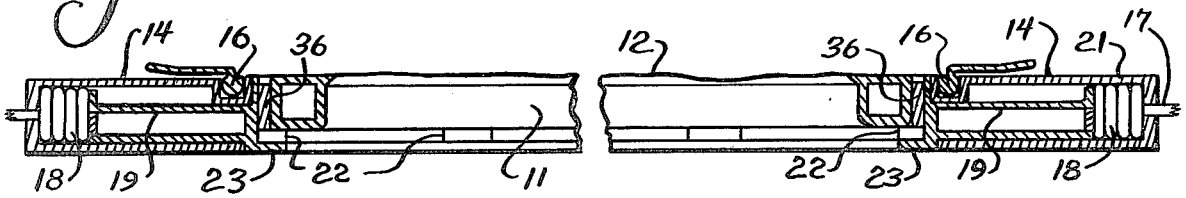
Fig. 4
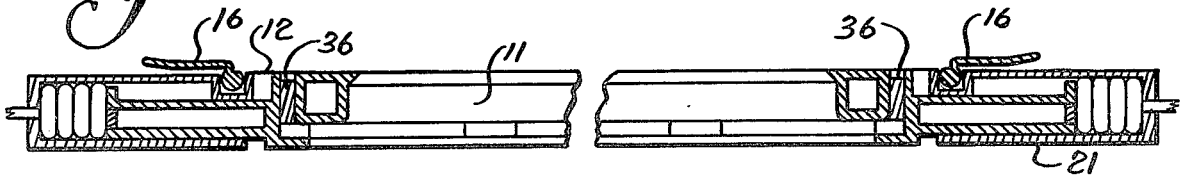
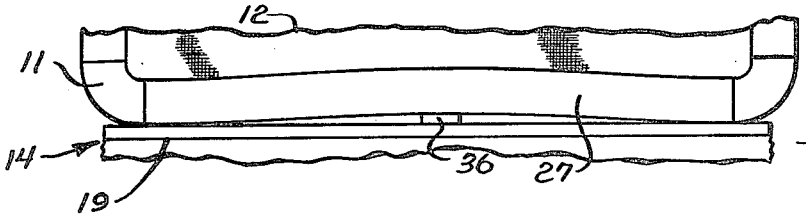
Fig. 5

SCREEN-PRINTING FRAME WITH PLASTIC SIDE BARS BONDABLE TO FABRIC BY SURFACE-SOFTENING

INTRODUCTION

The invention of which the present disclosure is offered for public dissemination in the event that adequate patent protection is available relates to screen printing. In screen printing, a screen serves much as a stencil to let ink or paint pass through it in a desired pattern. The screen comprises a cloth or wire fabric of very fine mesh stretched across a frame structure. The fabric must be in elastically stretched condition to hold itself minutely above the piece being printed, except when a squeegee, for example, presses the fabric into contact with the sheet being printed. The cost of the preparation of the frame assembly is of course a very appreciable part of the total cost of the screen-printing process. According to the present invention the cost of production of the frame assemblies is considerably reduced.

Most printing frame structures comprise four side bars permanently secured together at the corners, each frame thus being unalterable in size. The screen structures are very commonly made of wood or metal, and the fabric, after being tensioned across them, may then be secured by tacking, stapling, cording or by cementing. When used, tacks or staples must be applied throughout the whole length of the periphery of the frame structure. In cording, the fabric is secured with a cord peripherally pressed down into and down through the fabric into a groove in the frame. Cement may be applied more quickly, but requires time for setting. In these procedures, the fabric-stretching apparatus cannot be removed for another tensioning job until the securing of the fabric has been completed; and in the case of the cement, until the cement has set and hardened enough to hold safely.

In all of these methods the fabric is mutilated to some degree upon removal from the frame, rendering it unsuitable for re-use. The total costs reflect the long period of use of the stretching apparatus, and either the cost of labor of stapling or the cost of cement and cementing, plus the loss of fabric.

According to the present invention the total production time is decreased by using a plastic material in the frame structure amenable to surface-softening by the application of either heat or solvent to the surface; and bonding the fabric to the frame structure by means of such soft surface. Once the fabric has been tensioned over the frame structure, the softening of the surface of the frame structure material is accomplished inexpensively and so quickly that the completed frame can be removed from the stretching apparatus and production of a new frame assembly begun. The softening can be effected either by a solvent applied through the mesh of the fabric or by heat applied through the fabric. Upon being peeled from the frame the fabric suffers no damage to the extent that it cannot be re-used.

Further cost reduction results, in the preferred forms of the invention, from using a modular screen frame construction which greatly reduces stockpiling. A screen printing house then does not need to maintain a wide variety of frame structures to meet all dimensional needs, because each dimensional need can be readily satisfied from a small stock of long bars by cutting the bars to the particular lengths required. Preferably the bars are extruded of box cross section because this lends itself to modular construction and also provides a relatively good ratio of strength to weight. The cross sections of the tubular side members may be provided in a range of sizes and shapes to accommodate whatever frame sizes are required.

Ordinary unitary frames can be adapted to surface softening by applying a layer of softenable material. Also, such materials can be used for molding unitary frames.

Some plastics suitable for surface-softening tend to be flexible. This may present a problem with larger frames, because the plastic may flex somewhat and partially release the tension toward the central portion of the side bars. The frame side bars which are hollow can be stiffened if necessary by inserting a suitable bar of any material such as rough wood, particle board, metal or another plastic to decrease the bending moments. This problem can also be relieved, should it occur, by prestressing the side bars by forcefully flexing them to the shape they would have while holding the fabric properly tensioned.

The hollow side members can also be extruded from aluminum or other ductile metals, in which case the surface of the bar which is to receive the fabric can be faced with a plastic strip to accommodate the solvent or heat bonding procedures.

The advantages of the invention will be more fully understood from the drawings and from the description.

DESIGNATION OF FIGURES

FIG. 1 is a somewhat diagrammatic view of a screen printing frame assembly which might be deemed nearly completed, with the fabric secured to the frame structure and with one corner of the fabric and some portions of the frame structure broken away to show the preferred modular construction of the frame.

FIG. 2 is a perspective type of view on a larger scale for clarifying the modular construction, and also showing a preferred shape.

FIG. 3 is a vertical sectional view taken through a fabric-stretching apparatus with a screen therein, as the fabric has been secured in the stretching apparatus and is about to be stretched.

FIG. 4 corresponds to FIG. 3 but illustrates the fabric in stretched condition ready for bonding to the plastic side bars of the frame structure.

FIG. 5 illustrates somewhat diagrammatically one manner in which uniform tensioning of the completed fabric can be substantially ensured by pre-stressing the side bar so that after bonding of the fabric to it, it does not, upon release of the stretching apparatus, undergo a substantial change of shape or bowing which would reduce the tension at the central area of the bow.

FIG. 6 illustrates surface-softening using a solvent applied by a swab.

FIG. 7 illustrates surface-softening using a hot iron.

BACKGROUND DESCRIPTION

Screens for screen printing generally include a rigid frame or frame structure 11 of generally rectangular shape carrying a screen fabric 12 which is in elastically tensioned condition, stretched across the frame 11. In the past, the frames have not usually been of the modular type of construction shown in FIGS. 1 and 2, but have consisted of four side bars rigidly joined together at the four corners, as by mitering, to form a unitary frame. Likewise, the screen fabric 12 did not usually extend beyond the frame in finished frames, the illustration of FIG. 1 illustrating the preferred manufacturing process of the present invention.

In order to tension the fabric and hold it tensioned while it is mounted on the frame, it is conventional to use some sort of stretching apparatus surrounding the frame under which the tensioned fabric is to be mounted. Thus as illustrated in FIG. 3, pneumatic tensioning bars 14 may be used. Although shown on only two sides of the frame 11, they would normally be on all four sides. The form illustrated is more fully disclosed in U.S. Pat. No. 3,608,484. After the fabric 12 has been secured in the bar 14 on one side of frame 11 by a locking bar 16, it is drawn by hand smoothly across the frame 11 and secured at the opposite side of frame 11 to another stretching bar 14 by its locking bar 16. This is repeated with the other two locking bars. It may be necessary to loosen one or more locking bars 16 and readjust the fabric to avoid wrinkles and distortions, especially if the operator is a novice. When the fabric in sufficiently smooth and undistorted condition is locked to the four stretching bars 14, compressed air of a desired tensioning pressure is led to all of them through tubes 17. Each tube 17 leads to an expansion chamber such as a bellows or expandable tube 18, which will expand in length between a thrust bar 19 and a casing 21. If it be assumed that the thrust bars 19 rest against the opposite sides of frame 11, they cannot move and therefore the movement resulting from expansion of expansion chambers 18 is a movement of the two casings 21 away from each other, and away from the frame 11, to stretch or tension the fabric 12 while it lies in contact with the frame 11. Shims 22, resting on flanges 23 of the thrust bars 19, may be used for holding the frame 11 at just the right height for the fabric 12 to properly engage the face of the frame 11 when it has thus been stretched.

MODULAR CONSTRUCTION

Although modular constructions, such as illustrated in FIGS. 1 and 2, may not be new, the use of this type of construction contributes to the practicality of the preferred forms of the present invention, and in at least one respect there may be novelty in the modular construction.

In its illustrated form, the modular frame includes four unvarying corner pieces 26 for joining together four side bars 27, which are preferably of such composition and nature as to easily be cut to particular lengths depending upon the size of frame desired. According to a major aspect of the present invention described below, these four side pieces are preferably composed of plastic material or metal faced with plastic. This lends itself to the illustrated modular construction, in which the side bars are of box shape in cross section (hollow, rectangular) so that tenons 28 extending from corner pieces 26 may fit into them with sufficient snugness to provide corner rigidity for the frame 11.

The corner pieces 26 may conveniently be of cast aluminum. They may also be molded of plastic material, such as polyethylene, which will be rigid and not affected by frame softening or ink solvents. The material used for the plastic side bars 27 will depend upon the manner of securing the fabric to the side bars which is to be used, as discussed below. In order to disclose a preferred form of the present invention, inwardly extending lips 29 have been shown along the fabric engaging faces of both corner pieces 26 and side bars 27, although this structural design feature is not the subject of the present application.

SECURING FABRIC BY SURFACE-SOFTENING OF FRAME

The use of plastic material for side bars 27, or for entire unitary frames, lends itself admirably to one of the major features of the present invention, the securing of the fabric to the frame by surface softening of the frame, two methods being indicated in FIGS. 6 and 7.

When the fabric 12 has been tensioned to the desirable extent across the frame 11, it is secured to the face of frame 11 by softening the superficial surface of this face and impressing the fabric into the softened surface. Depending upon the physical characteristics of the plastic material of which the bars are composed, the softening may be effected by the softening action of solvent or by heat applied in either case to the frame 11 through the fabric 12. It should be understood that at this stage the fabric is all open, the printing pattern not yet having been applied to the fabric. Accordingly, the surface of the face of frame 11 against which the fabric 12 rests may be softened by applying a suitable solvent to this surface through the fabric, as illustrated in FIG. 6, by running a swab 31 soaked with the solvent along the areas where the fabric 12 engages the frame 11.

Alternatively, if a heat softenable plastic is used for the frame 11, the softening of the face may be accomplished by moving a hot iron 32 along the areas of engagement of the fabric and frame, as in FIG. 7. The heat softening method is usually the faster, and has the advantage that the iron which applies the heat may also impress the fabric into the softened surface, whereas with solvent a short time may be required for a sufficient softening to be accomplished, and it will usually be found desirable to impress the fabric into the softened surface by pressure applied to the fabric after the softening time has elapsed. Furthermore, with solvent-softening, more time must be allowed for the evaporation of the solvent than is required for cooling when softening is by heat. Nevertheless, even the slower solvent-softening method is considerably faster than methods formerly used, such as stapling the fabric to and all around the frame or applying epoxy cement through the fabric and allowing time for it to set and harden before the tensioning apparatus can be released for use on another frame.

SUITABLE MATERIALS

Although a wide variety of materials are suitable for this invention, the choice of material for the side bars depending upon such known physical characteristics of the plastic material as structural rigidity, solubility and thermoplasticity, some examples may be helpful. For the solvent-softening form of the invention, the class of materials known as ABS (acrylonitrile butadeine styrene) may be used, the grade thereof sold by Borg-Warner Corporation as Cycrolac having been found to be suitable. This material is a recognized structural plastic which provides great strength and rigidity. It is soluble in acetone and its surface may be quickly softened by the application of this solvent. Suitable, also, are the ketone solvents and methylene chloride. Inks used should not contain liquids in which the plastic of the bars is soluble; oleo-resinous and water based (e.g., latex) inks are suitable, and are the most commonly used in screen printing.

A material which has been found suitable for use in the heat softening method of this invention is polyethylene and more particularly, for example, the Tennessee Eastman plastic No. 1830A. This material is thermoplastic, having a softening temperature sufficiently lower than that of commercially used fabrics including polyester, nylon and silk as well as stainless steel, to be heat softened through them without damage to them. Polyethylene also has the property of resisting all solvents thus far commonly in use in any screen printing ink systems.

Nonmetallic fabrics can also be used with the solvent softening form of the invention, provided the solvent employed is specific so it will dissolve the frame surface material and not the fabric material.

PRE-STRESSING OF SIDE BARS

Except in the smaller sizes of frames, the use of plastic side bars may present a problem due to the flexibility, if more than minimal, of the plastic structure. Proper tensioning of the fabric of the screen is important in the printing process. A rather considerable degree of tension is required. With long, somewhat flexible side bars, there is danger that they will be sufficiently bowed inwardly by the fabric tension after release by the stretching apparatus that along the central portion of the lengths of the side bars the needed tensioning of the fabric may not be maintained. The tensioning applied by bars 14 evenly all along the length of the side bars may cease to have this uniformity as soon as the tensioning apparatus is released. The fabric tension applied to the side bars will then inevitably cause some bowing of the side bars. If the bowing is excessive, the screen will not be satisfactory.

One possible solution to this problem is to stiffen the side bars as by inserting into them stiffening core members of wood or like nature. However, any slack which must be taken up between the plastic and the stiffening members before they perform their stiffening function decreases the value of such stiffening members. Furthermore, they are likely not to be stiff enough to solve the problem when the side bars are very long.

Another aspect of the present invention solves this problem by the concept of pre-stressing the side bars. For example, the side bars can be extruded with a slightly arcuate shape, the parts being assembled with the bulge outward. Then, if pressure is applied to the bulge during stretching of the fabric to press the convex bulges on opposite sides toward one another until each side bar is straight, each side bar will be pre-stressed to the extent of the pressure required to thus straighten them. If this pressure is correlated to the tension of the fabric, the pre-stressing will enable the side bar to maintain the tension on the fabric without being bowed inwardly by this tension.

FIGS. 3 to 5 illustrate another form of pre-stressing of the side bars, a form which employs the more desirable straight side bars. This method can be used with frames of any construction having more flexibility than is tolerable for the length of the side bars. The general concept is to pre-stress the side bar by applying an inward bending force to it, as described above in connection with the arcuate side bar, but in this instance bowing the side bar from its natural straight shape to an inwardly bowed shape. Although this is repugnant to those accustomed to thinking of a bowed side bar as indicating a loss of the needed tension, it actually is a form of pre-stressing which prevents that loss of tension. It can be accomplished very simply with frames having side bars that are naturally straight, i.e., which are straight before any tension is applied to them. It is merely necessary to insert a small spacer 36 between the thrust bar 19 and the frame at the longitudinal center of the side bar. The centered position of the spacer 36, and its effect, are apparent from FIG. 5, although this figure is diagrammatic and incomplete in other respects. From FIG. 5 it is apparent that the force developed by the expansion chambers 18 and exerted inwardly by the thrust bar 19 has pressed against the spacer 36 until it has deformed the side bars 27 from its original straight shape to a bowed and pre-stressed shape. It should be recognized that with this form of stretching apparatus, the four thrust bars 19 are not parts of a rigid frame, but each is free to move inwardly. Now, when the fabric 12 is applied to the pre-bowed and pre-stressed side bar 27, made secure thereto, and the clamping bar 16 then released, the pre-stressed side bars 27 will have enough resistance to further bowing to withstand the forces applied to it by the tension of the fabric. This assumes that the thickness of the spacer 36 has been chosen to give a pre-stressing correlated to the tension of the fabric. In other words, the pre-stressing should be approximately equated to the fabric tension in the sense that when the pre-stressing force is removed and the fabric tension is allowed to be applied to the side bar instead, there will be little or no change in the shape of the side bar, thereby showing that the side bar is effectively resisting and maintaining the fabric tension.

An operator will quickly acquire judgment as to the thickness of spacer 36 required for each job. The length of the frame side bar and the nature of the fabric would be taken into consideration. Even initially, there need be no scrapped screens. One of the advantages of the securing of the fabric to the frame by surface softening is that it may be peeled from the frame when desired. Hence, if, when the operator vents the tensioning air pressure from the expansion chambers 18 to release the stretching apparatus, he observes that the side bars bow inwardly enough further so that the needed fabric tension is not maintained, he need merely peel the fabric off of the frame, substitute thicker spacers 36 for the ones he used, and repeat the previous operation. Even the pounds per square inch of air pressure may remain the same, because with the larger spacer 36, the same air pressure will result in greater pre-stressing of the side bars so that they will more nearly withstand the tension of the fabric without further inward bowing when the air pressure is vented.

ACHIEVEMENT

From the foregoing it is seen that considerable economy in the construction of screens for printing has been achieved. The securing of the fabric to the frame by one of the disclosed surface-softening methods represents an appreciable economy as compared to previous methods generally commercially practiced. The frame, itself, supplies the screen fabric bonding agent in situ. The method of the invention not only requires less time and labor, and may also afford some economy as to materials, but it also reduces the time that the frame must be left in the fabric-stretching apparatus, so that economy in the use of such apparatus results.

The preferred modular form of the invention also represents a considerable economy in avoiding the necessity of carrying a large stock of different sizes of frames. A given frame and the fabric can be used numerous times by simply peeling the fabric screen from the frame when a printing job has been completed and re-using the frame and the fabric.

The removed screens can, when future use is likely to be desired, be stored flat or rolled much more readily than if retained on the frame. Screens with wallpaper patterns, for example, may be re-used for printing additional runs. Another advantage of the peelability of the use screen from their frames in accordance with the invention resides in greater convenience in the washing of the screens since this can be done in relatively small tanks whereas large framed screens require very large wash tanks.

The surface-softening bonding technique of this invention avoids the disadvantages inherent in presently used procedures, tacking, cementing, cording and stapling. Cement may close screen holes which must be left open; also, removal of cement from the screen is very difficult. Damage to and quality impairment of screens resulting from fastening by means of tacks, staples and cords is avoided.

The surface-softening advantages can also be obtained with nonplastic; i.e., wooden or metal, frames by applying to the face of the frame to which the fabric is to be applied a layer of plastic suitable for the chosen method of surface softening. The pre-stressing of the side bars not only extends the use of plastic side bars, but also can be used for conventional styles of frames where the side bars would otherwise be too flexible. Even the use of nonsoftenable corners with side bars which are surface-softenable may be advantageous, inasmuch as there is no need that the corner areas of the fabric be secured. Although surface softening through the fabric is the simplest version of the surface-softening concept, quick application of the fabric to a pre-surface-softened frame may also be feasible.

I claim:

1. The method of making a printing screen consisting of a screen fabric and a frame, including the steps of:
   - providing a frame having at least the structural surface thereof for receiving fabric thereon formed of a plastic material capable of having its exposed surface rehardenably softened;
   - tensioning the fabric across said frame and in direct contact with said structural surface;
   - superficially softening said surface;
   - impressing the fabric into the softened material of said surface; and
   - while maintaining the tension of the fabric independently of action thereon by the frame, allowing said surface to harden to secure the fabric against yielding to the tension of the fabric.

2. The method of making a printing screen consisting of a screen fabric and a frame, including the steps of:
   - assembling a frame from corner pieces and side bars, the side bars being composed of material capable of being rehardenably surface-softened;
   - tensioning a screen fabric across said frame and in direct contact with its side bars;
   - superficially softening the side bar surfaces to which the fabric is to be secured; and
   - while maintaining the fabric tension independently of action of the frame thereon, impressing the fabric into the softened material of the side bars and allowing the material to harden to secure the fabric against yielding to the tension of the fabric.

3. The method of making a printing screen consisting of a screen and a frame, including the steps of:
   - assembling a frame from corner pieces and side bars, the side bars being composed of material capable of being rehardenably surface-softened;
   - tensioning a screen fabric across said frame and in direct contact with its side bars and pre-stressing the side bars to resist bending due to eventual fabric tension by applying a pressure inwardly against their middle portions to deform them inwardly;
   - superficially softening the side bar surfaces to which the fabric is to be secured; and
   - while maintaining the fabric tension independently of action thereof by the frame and maintaining the pre-stressing pressure against the side bars, impressing the fabric into the softened material of the side bars and allowing the material to harden to secure the fabric against yielding to the tension of the fabric.

4. The method of making a printing screen consisting of a screen fabric and a frame, including the steps of:
   - providing a frame having at least the structural surface thereof for receiving fabric thereon formed of a plastic material capable of having its exposed surface rehardenably softened;
   - tensioning the fabric across said frame and in direct contact with said structural surface;
   - superficially softening said surface by softening action applied through said fabric;
   - impressing the fabric into the softened material of said surface; and
   - while maintaining the tension of the fabric independently of action thereon by the frame, allowing said surface to harden to secure the fabric against yielding to the tension of the fabric.

5. The method of making a printing screen according to claim 4 in which the surface is softened by applying through the fabric a solvent more active on said surface than on the fabric.

6. The method of making a printing screen according to claim 4 in which the surface is softened by applying heat through the fabric, the surface material of the frame having a lower softening temperature than the material of the fabric.

7. The method of making a printing screen consisting of a screen fabric and a frame and preparing the frame for re-use, including the steps of:
   - providing a frame having at least the structural surface thereof for receiving fabric thereon formed of a plastic material capable of having its exposed surface rehardenably softened;
   - tensioning the fabric across said frame and in contact with said surface;
   - superficially softening said surface;
   - impressing the fabric into the softened material of said surface;
   - while maintaining the tension of the fabric independently of action thereon by the frame, allowing said surface to harden to secure the fabric against yielding to the tension of the fabric;
   - using the printing screen to complete its printing job; and
   - thereafter peeling the screen fabric away from the frame.

8. A printing screen consisting of a frame and a screen fabric carried by the frame in tensioned condition across the frame, the surface portion of the frame to which the fabric is secured being of a plastic material capable of being temporarily softened, and the fabric being secured directly to the structure of said frame by the structural characteristics resulting from the fabric having been impressed therein while said surface portion was temporarily softened and the material thereafter re-hardened.

9. A printing screen according to claim 8 wherein the fabric is impressed into the surface portion of the frame to such extent only that the fabric is secured against lateral movement along the surface of the frame but may be pulled outwardly away therefrom.

10. A printing screen according to claim 8 in which the frame is modular, separate side pieces being secured together as a rigid frame by corner pieces, the side pieces being of extruded plastic.

11. A printing screen according to claim 8 in which the frame is modular, separate side pieces being secured together as a rigid frame by corner pieces, the side pieces being composed of extruded plastic material, at least one pair of opposite side pieces being pre-stressed for stable maintenance of the fabric tension.

12. A printing screen according to claim 8 in which the frame is modular, separate side pieces being secured together as a rigid frame by corner pieces, the side pieces being composed of extruded plastic, at least some of the side pieces being in the pre-stressed state and deformed inwardly for stable maintenance of the fabric tension.

13. A printing screen according to claim 8 wherein the frame comprises four side members, said side members being composed of plastic material capable of being temporarily softened.

* * * * *